US006158482A

United States Patent [19]

Rubin

[11] Patent Number: 6,158,482

[45] Date of Patent: Dec. 12, 2000

[54] APPARATUS AND METHOD FOR FILLING CARBON DIOXIDE CYLINDERS

[76] Inventor: Julius Rubin, 54 Madison Ave., Franklin Square, N.Y. 11010

[21] Appl. No.: 09/268,060

[22] Filed: Mar. 15, 1999

[51] Int. Cl.[7] ..... B65B 1/04

[52] U.S. Cl. ..... 141/59; 141/197; 141/289

[58] Field of Search ..... 141/59, 197, 2, 141/18, 20, 44, 45, 285, 289, 290

[56] References Cited

U.S. PATENT DOCUMENTS

| | | | |
|---|---|---|---|
| 3,125,135 | 3/1964 | Boyer et al. | 141/59 |
| 5,569,375 | 10/1996 | Ridgeway | 141/59 |
| 5,765,602 | 6/1998 | Sutton et al. | 141/59 |
| 6,003,547 | 12/1999 | Tippmann, Jr. | 137/588 |

*Primary Examiner*—Steven O. Douglas
*Attorney, Agent, or Firm*—Paul W. Garbo

[57] ABSTRACT

A device for filling a high-pressure $CO_2$ cylinder with liquid $CO_2$ while venting gaseous $CO_2$ comprises a two-compartment chamber that is installed in the top opening of the cylinder. A first dip tube connected to one compartment extends to the bottom portion of the cylinder and a second dip tube connected to the other compartment extends to the upper portion of the cylinder. Each compartment has a port for flow into or out of the compartment. Liquid $CO_2$ introduced into the compartment with the first dip tube will flow into the cylinder and cause gaseous $CO_2$ to exit through the second dip tube and the other compartment. When liquid $CO_2$ appears in the exiting stream, the introduction of liquid $CO_2$ is stopped. In a common embodiment, a conventional $CO_2$ valve has the first dip tube connected to the bottom thereof. A street tee with one end connected to the second dip tube is screwed into the top opening of the cylinder. The $CO_2$ valve is screwed into the other end of the tee, the first dip tube extending with annular clearance through the second dip tube into the cylinder.

11 Claims, 3 Drawing Sheets

APPARATUS AND METHOD FOR FILLING CARBON DIOXIDE CYLINDERS

BACKGROUND OF THE INVENTION

This invention relates to an apparatus and method of filling carbon dioxide ($CO_2$) cylinders. More particularly, the invention involves filling liquefied $CO_2$ high pressure cylinders by passing liquefied $CO_2$ from a low pressure container of liquefied $CO_2$.

High pressure cylinders for liquefied $CO_2$ have a single valved port and, by long established practice, are filled at a recharging depot where liquefied $CO_2$ is pumped into each cylinder through its valved port. Filling is continued until the weight of $CO_2$ is equal to two-thirds of the weight of water that would fill the cylinder. This customary filling limit serves to provide a safe vapor space above the liquefied $CO_2$ in the cylinder.

In contrast to the common, laborious and costly practice of transporting each cylinder from a $CO_2$ user to a depot, filling it while carefully weighing the added $CO_2$ to avoid overfilling, and transporting the recharged cylinder back to the $CO_2$ user, the invention provides a system of supplying $CO_2$ to cylinders much like the familiar delivery of fuel oil to the tanks at several homes. In spite of the extensive distribution of $CO_2$ cylinders and the frequent need to transport each to a refilling depot and back again to the user, no practical proposal is known for obviating this cumbersome and expensive system of shuttling cylinders between $CO_2$ customers and a recharging depot.

Accordingly, a principal object of the invention is to provide an apparatus and method for filling cylinders at various locations with liquefied $CO_2$ from a large container that is transported to the various locations.

Another important object is to provide an apparatus for filling $CO_2$ cylinders which is simple to install and to use.

A further object is provide apparatus that automatically limits filling cylinders with liquid $CO_2$ to a selected safe level.

These and other features and advantages of the invention will be apparent from the description which follows.

SUMMARY OF THE INVENTION

In accordance with this invention, three basic elements have been added to the conventional $CO_2$ valve that is screwed into the threaded port at the top of a high-pressure cylinder for liquefied $CO_2$, namely, a street tee and two dip tubes. A first dip tube, usually a copper tube, is soldered or otherwise connected to the bottom opening in the conventional $CO_2$ valve. A second dip tube, larger in diameter than that of the first dip tube, usually a copper tube, is soldered of otherwise connected to the end of the tee that has a male thread matching the female threaded opening of the cylinder.

The $CO_2$ valve with the first dip tube is inserted into the opposite end of the street tie which has a female thread. The first dip tube extends through the second dip tube with an annular clearance between them. When the $CO_2$ valve is fully screwed into the top female end of the tee, and the bottom male end of the tee is fully screwed into the threaded opening of the cylinder, the bottom end of the first dip tube will be close to, preferably only about 1 inch above, the bottom of the cylinder. By contrast, the second dip tube will extend down only about one-third of the internal length of the cylinder. Thus, liquid $CO_2$ introduced through the conventional $CO_2$ valve flows down the 30 first dip tube into the bottom of the cylinder while gaseous $CO_2$ passes up the second dip tube and out of the tee through its side opening which may be provided with a valve.

The level of liquid $CO_2$ in the cylinder will keep rising during the filling operation until it reaches the bottom end of the second dip tube. Up to that point, gaseous $CO_2$ has been leaving the cylinder by flowing up the second dip tube through the annular space between it and the first dip tube and into the street tee from which it exits at the side opening of the tee.

As soon as the level of liquid $CO_2$ reaches the bottom end of the second dip tube, the gaseous $CO_2$ in the cylinder above the liquid develops sufficient pressure to cause liquid $CO_2$ to flow up the second dip tube and out of the tee through its side opening. The escaping liquid $CO_2$ flashes into $CO_2$ snow which 10 signals that the desired liquid $CO_2$ capacity of the cylinder has been reached and the further supply of liquid $CO_2$ to the cylinder should be terminated.

Thereupon, the conventional $CO_2$ valve is closed to stop the flow of liquid $CO_2$ into the cylinder and a valve at the side opening of the street tee is also closed to stop the escape of gaseous $CO_2$ from the cylinder. Then the valve connected to the side of the tee has its discharge end connected to tubing that can convey gaseous $CO_2$ to a desired use station, such as a beer dispenser or a soda fountain, and the valve is opened to permit gaseous $CO_2$ flow to the use station.

It is noteworthy that the invention involves the simple assembly of three common plumbing elements with the conventional $CO_2$ valve. Two of the three added elements are merely lengths of metal tubing, further highlighting the simplicity and low cost of the apparatus of the invention that eliminates the continuous, cumbersome and expensive transportation of cylinders between $CO_2$ use sites and $CO_2$ supply depots.

However, it should be noted that the composite of the $CO_2$ valve and street tee provides in effect a metal chamber with two 30 compartments: a liquid $CO_2$ feed compartment in the $CO_2$ valve above a $CO_2$ vapor exit compartment in the tee. Therefore, stated more generally, the invention involves a metal chamber that can be screwed into the top opening of a $CO_2$ cylinder, the metal chamber having a wall therein to provide two compartments. Each compartment has a port to the exterior of the chamber and each has a dip tube connected thereto and extending into the $CO_2$ cylinder, the two tubes having different lengths. However, in its basic form, the invention comprises means for sealing the top opening of a $CO_2$ cylinder and for holding two dip tubes extending therethrough into the cylinder to different levels therein.

BRIEF DESCRIPTION OF THE DRAWINGS

To facilitate the further description and understanding of the invention, reference will be made to the accompanying drawings of which.

DESCRIPTION OF PREFERRED EMBODIMENTS

Figure 1:
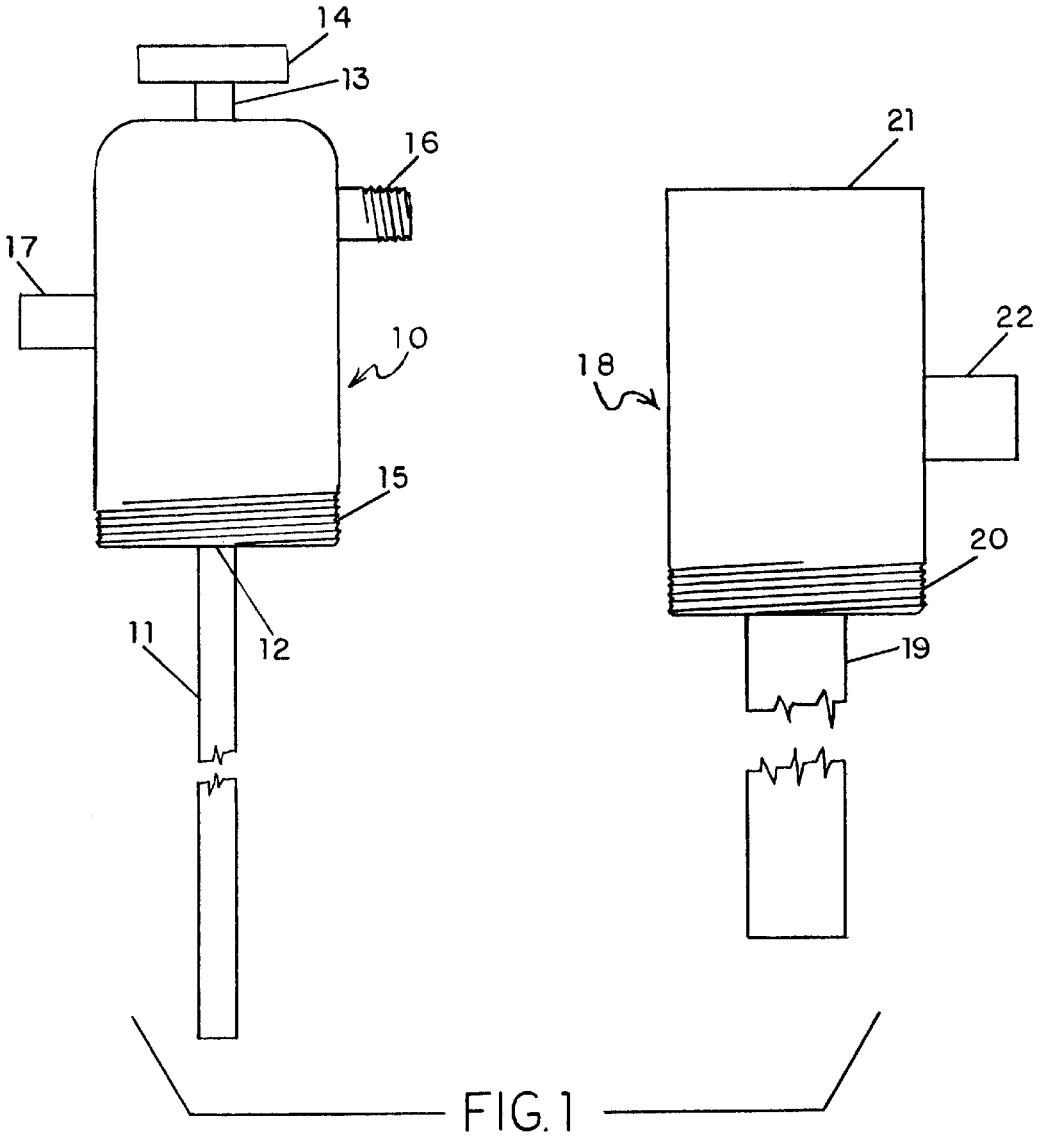
FIG. 1 is a schematic representation of a conventional $CO_2$ valve and three basic plumbing elements that can be assembled to form the apparatus of this invention.

The components of the apparatus of the invention in its common form are shown disassembled in FIG. 1. A standard $CO_2$ cylinder valve 10 is shown with a single addition thereto of a first dip tube 11 attached to the central opening 12 at the bottom of valve 10 which has the usual valve stem 13 and knob 14 at the top thereof. The bottom end of valve 10 has a male thread 15 matching the female thread of the sole opening at the top of the $CO_2$ cylinder in which valve 10 was screwed prior to this invention. Valve 10 has a threaded port 16 for the flow of $CO_2$ and a lateral cell 17 containing a safety disk that will rupture and release the pressure in the $CO_2$ cylinder if the pressure exceeds a predetermined safe maximum.

The other basic components are a street tee 18 and a second dip tube 19 connected to the opening at the end of tee 18 which has male thread 20 chosen to match the female thread of the top opening of the $CO_2$ cylinder into which tee 18 will be screwed. The top end 21 of street tee 18 has a female thread matching the male thread 15 of $CO_2$ valve 10 so that valve 10 and tee 18 can be screwed together.

Tube 11 connected to $CO_2$ valve 10 is longer and smaller in diameter than tube 19 connected to street tee 18. In order to screw valve 10 and tee 18 together, the first dip tube 11 is inserted in top end 21 and through tee 18 and second dip tube 19 until the bottom of valve 10 is against the top end 21 of tee 18. Valve 10 and tee 18 are then screwed together and are ready to be installed in a $CO_2$ cylinder by inserting the concentric first and second dip tubes 11,19 through the top opening in the $CO_2$ cylinder until tee 18 reaches the female threaded opening at the top of the $CO_2$ cylinder. Male threaded end 20 of tee 18 is then screwed into the top of the $CO_2$ cylinder to complete the installation of the apparatus of the invention. The lateral port 22 of street tee 18 serves as the discharge opening for the withdrawal of gaseous $CO_2$ from the cylinder as will be explained in the description of FIG. 2.

Figure 2:
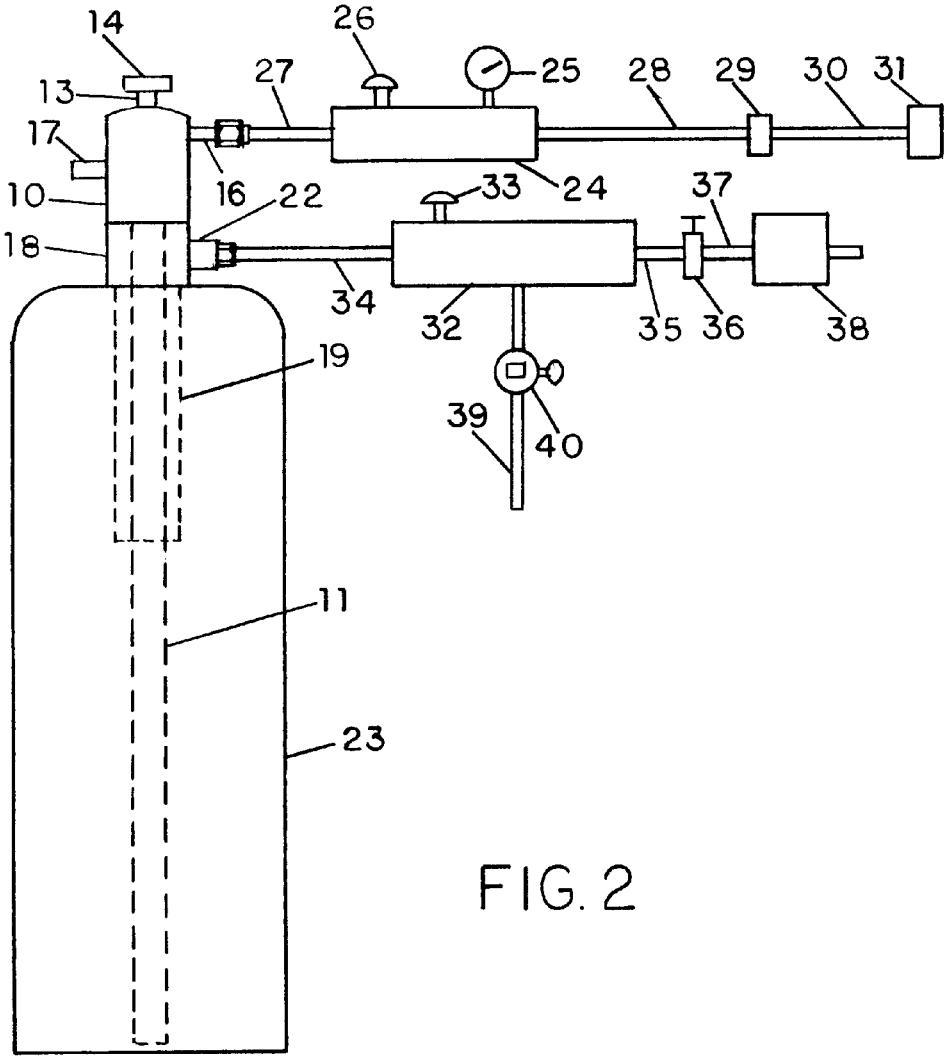
FIG. 2 is a similar illustration of the items of FIG.1 when assembled and installed on a high-pressure $CO_2$ cylinder.

FIG. 2 is a diagrammatic representation of the apparatus of the invention as installed in a high-pressure $CO_2$ cylinder together with typical accessories used with the cylinder. The components of FIG. 1, when assembled as the apparatus of the invention, are shown installed in a $CO_2$ cylinder 23.

First dip tube 11 extends from the bottom of $CO_2$ valve 10 to close to, say 1 to 2 inches from, the bottom of cylinder 23. Second dip tube 19 surrounding tube 11 extends from the bottom of tee 18 about one-third down the inside length of cylinder 23. More precisely, the length of second tube 19 is determined by a long established regulation for high-pressure $CO_2$ cylinders. That regulation specifies that the maximum quantity of liquefied $CO_2$ in a cylinder shall not exceed two-thirds of the weight of water that will fill the cylinder. This formula ensures a safe vapor zone in the cylinder above the liquid $CO_2$ therein. Too small a vapor zone is dangerous because a very high pressure could develop in the cylinder to the point of exploding it.

To introduce liquid $CO_2$ into cylinder 23, the apparatus of the invention makes it possible for liquid $CO_2$ to flow from a supply container into $CO_2$ valve 10 through port 16. The liquefied $CO_2$ flows down valve 10 and first dip tube 11, discharging into the bottom of cylinder 23. Gaseous $CO_2$ evolved from the liquid rises in cylinder 23 and flows up second dip tube 19 into tee 18 exiting therefrom through lateral port 22. When the liquid level in cylinder 23 reaches the bottom end of second tube 19, $CO_2$ vapor in the top of cylinder 23 is trapped. If additional liquid $CO_2$ is introduced into cylinder 23, liquid will rise in second tube 19 and flash out of port 22 into dry ice snow. The snow is a visual notice that the cylinder has been filled with the allowable maximum quantity of liquid $CO_2$ and that the flow of liquid $CO_2$ into cylinder 23 should be stopped.

To facilitate the introduction of liquid $CO_2$ and the withdrawal of gaseous $CO_2$, high-pressure cylinder 23 is connected to known accessories. A manifold 24 equipped with pressure gauge 25 and pressure relief valve 26 is connected by tube 27 to port 16 of $CO_2$ valve 10. In accordance with this invention, manifold 24 is connected by tube 28 to liquid check valve 29 which is connected to supply tube 30. A quick coupler 31 is attached to tube 30 to facilitate the connection of a hose extending from a low-pressure (usually about 300 pounds per square inch) container of liquid $CO_2$ on a truck driven to the building containing the bar or soda fountain where the $CO_2$ cylinder requires replenishment of liquid $CO_2$. It should be noted that, in the arrangement shown, valve stem 13 with knob 14 has been turned to the open setting and there never is a need to close it because check valve 29 automatically prevents back-flow through $CO_2$ valve 10. It is well to note that in the conventional use of $CO_2$ valve 10 port 16 serves only for the withdrawal of gaseous $CO_2$ from a high-pressure cylinder. Pursuant to the invention, port 16 is used to introduce liquid $CO_2$ into a cylinder.

Manifold 32 equipped with pressure relief valve 33 is connected by tube 34 to lateral port 22 of tee 18. Manifold 32 is connected by tube 35 to ball valve 36 which is connected by tube 37 to muffler 38. Tube 39 equipped with pressure regulator 40 and connected to manifold 32 serves to convey gaseous $CO_2$ from cylinder 23 to a desired use site such as a soda fountain. Manifold 32 may have several ports so that additional tubes like tube 39 can convey gaseous $CO_2$ to different use sites.

When cylinder 23 requires replenishment of liquid $CO_2$, a truck carrying a low-pressure container filled with liquid $CO_2$ will park near the building in which the cylinder is housed and a hose connected to the liquid $CO_2$ container will be drawn to connect it to quick coupler 31. The high pressure, say 700 pounds per square inch, in cylinder 23 is reduced by opening valve 36 until the pressure drops to a pressure about 15 pounds below the pressure in the supply container. As soon as the pressure in the cylinder drops below that in the supply container, liquid $CO_2$ flows from the hose through components 30,29,28,24,27,16,10 and 11 into the bottom of cylinder 23. Simultaneously, $CO_2$ vapor evolved from the liquid in cylinder 23 rises and flows up the annular space between first and second dip tubes 11,19 and through components 18,22,34,32,35,36,37 and 38 where the $CO_2$ vapor is vented to the atmosphere. When the level of liquid $CO_2$ reaches the bottom of second dip tube 19, gaseous $CO_2$ can no longer flow into tube 19 and the pressure of gaseous $CO_2$ trapped in the top of cylinder 23 builds up so that liquid $CO_2$ begins to rise in dip tube 19 and flow through components 18,22,34,32,35,36,37, exhausting from muffler 38 in the form of dry ice. The appearance of dry ice at muffler 38 is the visual sign that cylinder 23 has been filled with the allowable maximum quantity of liquid $CO_2$. Thereupon, the hose is disconnected from quick coupler 31 and valve 36 is closed. The accessories shown in FIG. 2 make it possible to draw gaseous $CO_2$ from cylinder 23 through tube 39 at any time including while liquid $CO_2$ is being introduced into cylinder 23. This is an additional benefit of the invention; heretofore, the flow of gaseous $CO_2$ to a soda fountain or other use site was interrupted while a depleted cylinder was being replaced with a freshly charged cylinder.

FIG. 2 shows a single cylinder 23 connected by tubes 27,34 to manifolds 24,32, respectively. However, several cylinders can be connected by similar tubes to both manifolds 24,32; multiple cylinders are desirable for large users of gaseous $CO_2$. It has already been pointed out that manifold 32 can have several tubes 39 to convey gaseous $CO_2$ to different use stations. Hence, manifolds 24,32, make it possible to supply liquid $CO_2$ simultaneously to several cylinders 23 connected in parallel thereto as well as permit the flow of gaseous $CO_2$ to several use stations without any interruption.

The simplicity of the invention is enhanced by the fact that all of the components are common plumbing parts. For example, both dip tubes 11,19 and all the tubes connected to manifolds 24,32 can be copper tubing. Optional muffler 38 is used to deaden the sound of escaping $CO_2$ during the filling of cylinder 23 with liquid $CO_2$. While the flow of liquid $CO_2$ from the low-pressure container on the truck to a cylinder requiring replenishment can take place merely because the pressure in the supply container is higher than that in the cylinder, a pump mounted on the truck may be used to hasten this filling operation.

Figure 3:
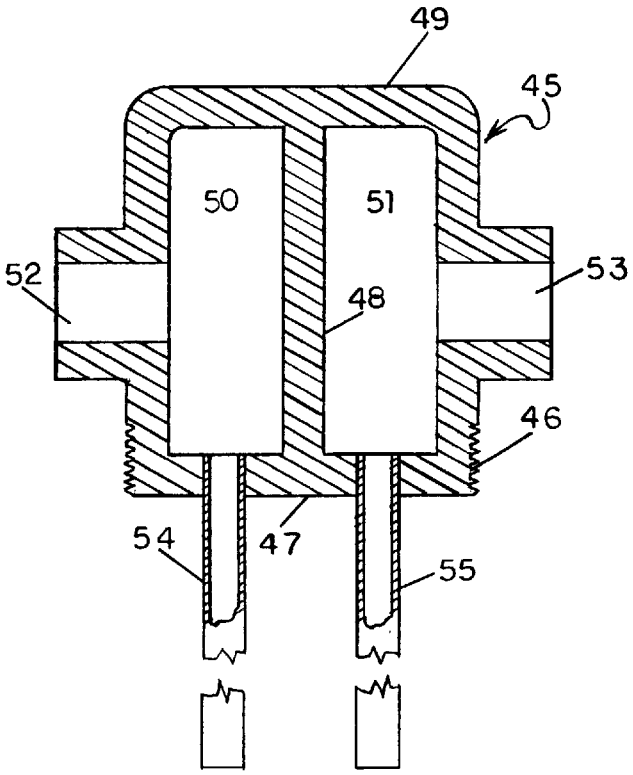
FIG. 3 is a cross-sectional view of a specially designed apparatus that may be used in lieu of that shown in FIG.1.

Even though the apparatus shown in FIG. 1 is formed of readily available components that are not expensive, the functions of that apparatus, namely, the simultaneous introduction of liquid $CO_2$ into, and venting of $CO_2$ vapor from, a cylinder can be achieved with a specially designed apparatus. FIG. 3 is a cross-sectional view of one such apparatus. A cylindrical metal chamber 45 has a male thread 46 at one end 47 which matches the female thread of the sole top opening of the $CO_2$ cylinder into which chamber 45 will be screwed. A wall 48 extends from end 47 to the opposite end 49, dividing chamber 45 into two compartments or sections 50,51. Ports 52,53 in chamber 45 communicate with sections 50,51, respectively. Dip tubes 54,55 connected to sections 50,51, respectively, through end 47 of chamber 45 complete another embodiment of the invention. Of course, in accordance with the invention, dip tubes 54,55 will have distinctly different lengths. Thus, if tube 54 is longer than tube 55, liquid $CO_2$ introduced through port 52 will flow into the cylinder while $CO_2$ vapor will rise through tube 55 and exit through port 53. A valve will be connected to each of ports 52,53 for flow control.

Figure 4:
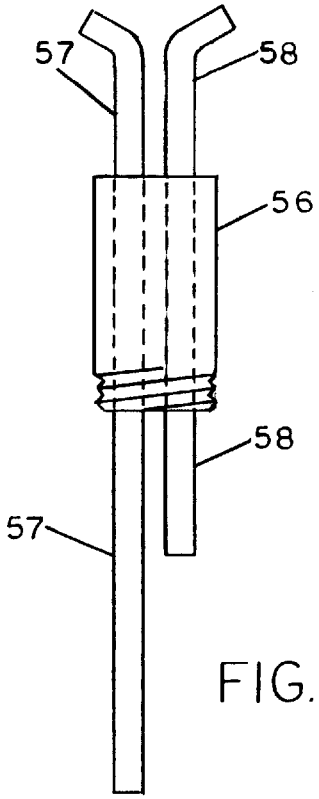
FIG. 4 is a front view of the apparatus of the invention in its simplest and basic embodiment.

FIG. 4 shows that, fundamentally, the invention requires only a threaded plug 56 which can be screwed into the sole female-threaded opening at the top of a $CO_2$ cylinder, and two tubes 57,58 extending through plug 56, one tube 57 reaching close to the bottom of the cylinder and the other tube 58 reaching down only a minor fraction, say about one third, of the height of the cylinder, as illustrated in FIG. 2. Of course, the exterior ends of tubes 57,58 would be connected to the usual accessories, such as those shown in FIG. 2, to facilitate the flow of liquid $CO_2$ down through tube 57 into the cylinder and the flow of $CO_2$ vapor up through tube 58 and out of the cylinder. A third tube may be included in plug 56 to serve as an alternate draw-off tube for gaseous $CO_2$ in the event that liquid $CO_2$ in tube 58 upon expanding through a regulator (not shown) on tube 58 became clogged with dry ice. Such a third tube would not need to extend below the threaded end of plug 56. In lieu of the third tube, it may be preferable to interpose a street tee (like tee 18 of FIG. 1 without dip tube 19) between the top opening of the $CO_2$ cylinder and plug 56 as shown in FIG. 4. Thus, the lateral opening of the tee would serve, like a third tube, for the withdrawal of gaseous $CO_2$ free of liquid.

To summarize, each of the different structural forms of the apparatus of the invention illustrated in FIGS. 1 to 4 provides means for sealing the top opening of a $CO_2$ cylinder and two flow passageways extending therethrough into the cylinder to different levels therein.

Those skilled in the art will visualize variations and modifications of the invention as hereinbefore illustrated without departing from the spirit of scope of the invention. For example, the conventional $CO_2$ cylinder valve can be replaced in FIG. 1 by an elbow with a dip tube connected to the end of the elbow which is screwed into the street tee. In any of the embodiments of the invention, the external portion of the tube used for venting $CO_2$ may be provided with an electric heater to eliminate any plug of dry ice that might form therein. Such a heater on the external portion of tube 58 in FIG. 4 is a practical substitute for the optional third tube discussed in relation to FIG. 4. Accordingly, only such limitations should be imposed on the invention as are set forth in the appended claims.

What is claimed is:

1. An apparatus for introducing liquid $CO_2$ into a high-pressure cylinder having a single top opening and simultaneously venting gaseous $CO_2$ from said cylinder, which comprises sealing means for said top opening, and two flow passageways extending through said sealing means into said cylinder to different levels therein, the passageway extending to a lower level in said cylinder serving for the introduction of liquid $CO_2$ and the passageway extending to a higher level in said cylinder serving for the venting of gaseous $CO_2$ from said cylinder.

2. The apparatus of claim 1 wherein the sealing means is a chamber with two compartments, and each flow passageway has a port into one of said compartments and a dip tube extending down from said compartment into the cylinder.

3. In a high-pressure $CO_2$ cylinder having a top threaded opening, the improvement of means for introducing liquid $CO_2$ into, and simultaneously venting gaseous $CO_2$ from, said cylinder, which comprises a two-compartment chamber installed in said top opening, a first dip tube for introducing liquid $CO_2$ connected to one compartment and extending into the bottom portion of said cylinder, a second dip tube for venting gaseous $CO_2$ connected to the other compartment and extending into the upper portion of said cylinder, and a port to each compartment outside said cylinder.

4. The improvement of claim 3 wherein the two-compartment chamber is formed by a conventional $CO_2$ valve screwed to one end of a street tee to provide a first compartment above a second compartment provided by said tee, the other end of said tee being installed in the top opening of the $CO_2$ cylinder, the first dip tube is connected to said first compartment, the second dip tube is connected to said second compartment, the lateral opening of said $CO_2$ valve is the port to said first compartment, and the lateral opening of said tee is the port to said second compartment.

5. The method of filling the improved $CO_2$ cylinder of claim 3 with liquid $CO_2$ while venting gaseous $CO_2$ therefrom, which comprises introducing liquid $CO_2$ into the compartment with the connected first dip tube, while venting gaseous $CO_2$ from the compartment with the connected second dip tube, and stopping the introduction of liquid $CO_2$ when the vented $CO_2$ includes liquid and/or solid $CO_2$.

6. The method of filling the improved $CO_2$ cylinder of claim 4 with liquid $CO_2$ while venting gaseous $CO_2$ therefrom, which comprises introducing liquid $CO_2$ into the $CO_2$ valve while venting gaseous $CO_2$ through the lateral opening of the tee, and stopping the introduction of liquid $CO_2$ when the vented $CO_2$ includes liquid and/or solid $CO_2$.

7. An apparatus for filling a high-pressure cylinder having a top threaded opening with liquid $CO_2$ and simultaneously venting gaseous $CO_2$ from said cylinder, which comprises a street tee with first and second end ports and a lateral port having said first end port screwed into said top opening, a first dip tube connected to said first end port and extending into the upper portion of said cylinder, a conventional $CO_2$ valve with a lateral port and a bottom hole, a second dip tube connected to said bottom hole, said second tube being smaller in diameter to fit loosely in said first tube, said $CO_2$ valve with said second tube being screwed into said second end port of said tee so that said second tube extends through said tee and said first tube into the bottom portion of said cylinder, said lateral port of said $CO_2$ valve serving as inlet for liquid $CO_2$ and said lateral port of said tee serving as outlet for gaseous $CO_2$.

8. The method of introducing liquid $CO_2$ into a high-pressure cylinder equipped with the apparatus of claim 7 and simultaneously venting gaseous $CO_2$ from said cylinder, which comprises introducing liquid $CO_2$ into the lateral port of the $CO_2$ valve, venting gaseous $CO_2$ through the lateral port of the street tee, and terminating the introduction of liquid $CO_2$ when the vented $CO_2$ is liquid and/or solid.

9. The method of filling a high-pressure cylinder having a top opening with liquid $CO_2$ while venting gaseous $CO_2$ therefrom, which comprises installing in said top opening a sealing device having two flow passageways extending therethrough to different levels in said cylinder, introducing liquid $CO_2$ into the passageway that extends to a low level in said cylinder, venting gaseous $CO_2$ through the passageway that extends to a higher level in said cylinder, and stopping the introduction of liquid $CO_2$ when the vented $CO_2$ becomes liquid and/or solid.

10. The method of claim 9 wherein the sealing device is a chamber having a first compartment with a port and a first dip tube extending to a low level in said cylinder for the introduction of liquid $CO_2$ and a second compartment with a port and a second dip tube extending to a higher level in said cylinder for the venting of gaseous $CO_2$.

11. The method of claim 10 wherein the first compartment is a conventional $CO_2$ valve and the second compartment is a street tee.

* * * * *